US011293141B2

(12) United States Patent
Alias et al.

(10) Patent No.: US 11,293,141 B2
(45) Date of Patent: Apr. 5, 2022

(54) FABRIC FOR A WEB-PRODUCING MACHINE AND SUCH A MACHINE WITH A CORRESPONDING FABRIC

(71) Applicant: VOITH PATENT GMBH, Heidenheim (DE)

(72) Inventors: Anas Alias, Perak Darul Ridzuan (MY); Uwe Koeckritz, Heidenheim (DE); Izharraj Karapayah, Perak Darul Ridzuan (MY)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 17/265,006

(22) PCT Filed: Jun. 13, 2019

(86) PCT No.: PCT/EP2019/065490
§ 371 (c)(1),
(2) Date: Feb. 1, 2021

(87) PCT Pub. No.: WO2020/025209
PCT Pub. Date: Feb. 6, 2020

(65) Prior Publication Data

US 2021/0310192 A1 Oct. 7, 2021

(30) Foreign Application Priority Data

Aug. 1, 2018 (EP) ..... 18186786

(51) Int. Cl.
*D21F 7/12* (2006.01)
*D21F 7/08* (2006.01)
*D21F 9/02* (2006.01)

(52) U.S. Cl.
CPC ..... *D21F 7/12* (2013.01); *D21F 7/083* (2013.01); *D21F 9/02* (2013.01)

(58) Field of Classification Search
CPC . D21F 7/08; D21F 7/10; D21F 7/0837; D21F 1/0027; D21F 1/0036; D21F 1/0045; D03D 11/02; D03D 3/04
(Continued)

(56) References Cited

U.S. PATENT DOCUMENTS 4,621,663 A * 11/1986 Malmendier ..... D21F 1/0036 139/383 A
5,089,324 A * 2/1992 Jackson ..... D21F 1/0027 139/383 A
(Continued)

FOREIGN PATENT DOCUMENTS

WO 9104374 A1 4/1991
WO 9301350 A1 1/1993

*Primary Examiner* — Eric Hug
(74) *Attorney, Agent, or Firm* — Laurence A. Greenberg; Werner H. Stemer; Ralph E. Locher

(57) ABSTRACT

A fabric for a web-producing machine, such as a papermaker's machine for producing paper, tissue or board, contains a machine-side and a paper-side. The fabric further contains MD-yarns and CD-yarns interwoven with each other in a predetermined repeat pattern. The MD-yarns 12 have a non-circular cross-section, and a width-to-height aspect ratio of the MD-yarns 12 is greater than 10:1, preferably at least 11:1. Furthermore, a web-producing machine, such as a papermaker's machine for producing paper, tissue or board, contains a fabric of the above described type, where the fabric is preferably applied in a dryer section of the web-producing machine.

18 Claims, 2 Drawing Sheets

(58) Field of Classification Search
USPC ..... 162/348, 358.2, 900, 902, 903, 904;
139/383 A, 425 A, 383 AA
See application file for complete search history.

(56) References Cited

U.S. PATENT DOCUMENTS

| | | | | | |
|---|---|---|---|---|---|
| 5,103,874 | A * | 4/1992 | Lee | D21F 1/0036 | 139/383 A |
| 5,117,865 | A * | 6/1992 | Lee | D21F 1/0036 | 139/383 A |
| 7,740,029 | B2 * | 6/2010 | Hodson | D21F 1/0027 | 139/383 A |
| 2008/0196784 | A1 * | 8/2008 | Quigley | D21F 1/0045 | 139/383 A |

* cited by examiner

FABRIC FOR A WEB-PRODUCING MACHINE AND SUCH A MACHINE WITH A CORRESPONDING FABRIC

BACKGROUND OF THE INVENTION

Field of the Invention

The present invention concerns a fabric for a web-producing machine, such as a papermaker's machine for producing paper, tissue or board, comprising a machine-side and a paper-side and further comprising MD-yarns and CD-yarns interwoven with each other in a predetermined repeat pattern, wherein the MD-yarns have a non-circular cross-section. Furthermore, the present invention concerns a web-producing machine comprising such a fabric.

Such a fabric is described for example in prior art document WO9301350A1. More specifically, this prior art document discloses a dewatering fabric for the press section of a paper making machine, the fabric comprising at least two distinct layers of flattened monofilament warp yarns, wherein an aspect ratio from about 4:1 to about 10:1 is mentioned as desirable.

However, the fabrics known from the prior art are still not optimal, especially in view of production cost and time.

SUMMARY OF THE INVENTION

It is the aim of the present invention to provide a fabric for a web-producing machine that overcomes the above-mentioned problem.

According to the present invention the problem is solved by a fabric exhibiting the features of the independent claim. Beneficial embodiments are the subject-matter of the dependent claims.

Consequently, the problem is solved by a fabric for a web-producing machine, such as a papermaker's machine for producing paper, tissue or board, comprising a machine-side and a paper-side and further comprising MD-yarns and CD-yarns interwoven with each other in a predetermined repeat pattern, wherein the MD-yarns have a non-circular cross-section and wherein a width-to-height aspect ratio of the MD-yarns is greater than 10:1, preferably at least 11:1.

With such an extremely high width-to-height aspect ratio, i.e. with an extremely flat design of the MD-yarns it is possible to make the manufacturing process faster and, thus, more cost-efficient. Enlarging the width-to-height aspect ratio of the MD-yarns means to reduce the number of applied MD-yarns in the production process of the fabric. Thus, the time needed e.g. for spooling, knotting and drawing can be significantly reduced. Furthermore, the time needed for the preparation of the seaming area can also be reduced which normally is a very time-consuming process step since the warp yarns have to be woven back into the fabric structure one by one. Moreover, by applying extremely flat MD-yarns the risk of skew to the fabrics during particularly the heat-setting process can be reduced and fabric abrasion resistance properties are improved. Thus, it is possible to enhance fabric quality by providing a better stability of the fabric.

Preferably, the fabric is a dryer fabric of a papermaker's machine. In such a case, the extremely flat design of the MD-yarns brings along another important advantage in comparison to the woven dryer fabrics known from the prior art, namely an improved drying rate of paper in paper machine due to an increase in surface contact area. In the dryer section of a papermaker's machine the fibrous web, such as paper, is sandwiched between the dryer fabric and the heated surface of dryer cylinders. Usually the fibrous web thereby meanders along a series of dryer cylinders. The larger the surface contact area of the fibrous web to the surface of the heated cylinders and the dryer fabric the more energy efficient is the drying process.

In a preferred embodiment of the present invention the aspect ratio of the MD-yarns is not greater than 15:1, preferably not greater than 12:1. If the aspect ratio becomes too large the weaving process of the fabric becomes difficult and the air permeability of the fabric might be negatively affected. However, it is the merit of the inventors to have found out—against the prejudices of the prior art—that at least a width-to-height aspect ratio of the MD-yarns between 10:1 and 15:1, preferably between at least 11:1 and not more than 12:1 is perfectly viable, providing the above advantages, as the production of sample fabrics has shown.

Good results have been obtained if the width of the MD-yarns is between 2.0 mm and 2.4 mm, preferably about 2.2 mm, and/or the height of the MD-yarns is between 0.1 mm and 0.3 mm, preferably about 0.2 mm. For example the width of the MD-yarns might be 2.2 mm and the height of the MD-yarns might be 0.2 mm. Preferably all MD-yarns in the fabric have the same shape and the same width-to-height aspect ratio.

In a preferred embodiment, the fabric is a double-layer fabric comprising an upper layer in which upper-layer MD-yarns interlace with the CD-yarns, and a lower layer in which lower-layer MD-yarns interlace with the CD-yarns, wherein the upper-layer MD-yarns do not intersect with the lower-layer MD-yarns. Thus, there may exist two systems of MD-yarns that are interwoven with one system of CD-yarns. Notably, in the seam area of the fabric the upper-layer MD-yarns might be woven back into the weave structure of the fabric to form seam loops and/or binder loops, wherein in such a case the upper-layer MD-yarns might continue their path as lower-layer MD-yarns.

It is possible that some of the CD-yarns are located along their complete path between the upper-layer MD-yarns and the lower-layer MD-yarns, thus, not being visible from the paper-side and/or the machine-side of the fabric, whereas the remaining CD-yarns are at least partly visible from the paper-side and/or the machine-side of the fabric. In such a case, the CD-yarns that are located along their complete path between the upper-layer MD-yarns and the lower-layer MD-yarns may have no or only a very small crimp whereas the remaining MD-yarns may have a significantly greater crimp.

In a preferred embodiment the MD-yarns and/or the CD-yarns are made of monofilaments, preferably of a polymeric material, such as PET, PPS, PCTA and/or POK. POK stand for polykentones, that is a family of high-performance thermoplastic polymers. POK is preferred as material for MD-yarns and/or CD-yarns, because POK exhibits similar hydrolysis resistance compared to PPS, and at the same time it has a better abrasion resistance and strength compared to PPS and also to PCTA. Furthermore the material of POK is usually less expensive than the material of PPS.

Furthermore, the MD-yarns can have a flattened shape with a substantially flat upper surface side and a substantially flat lower surface side, wherein the upper surface side and the lower surface side extend substantially parallel to each other. Such a design of the MD-yarns provide good abrasion resistance and a high contact area to the fibrous web to be carried on the fabric. For example, the MD-yarns may have a substantially octagonal cross-section.

In contrast to the MD-yarns the CD-yarns have preferably a substantially circular cross-section, wherein the diameter of the CD-yarns is preferably not smaller than 0.5 mm and/or not lager than 1.0 mm.

The inventors found out that good results can be obtained if the fabric comprises at least two groups of CD-yarns with differently dimensioned cross-sections. For example, the fabric can comprise at least a first group of CD-yarns with a circular cross-section of a first diameter and a second group of CD-yarns with a circular cross-section of a second diameter, the second diameter being greater than the first diameter, wherein a ratio of the second diameter to the first diameter is preferably between 2:1 and 1:1, more preferably about 3:2.

In such a case a design is preferred in which the CD-yarns of the second group are not visible from the paper-side and/or the machine-side of the fabric, whereas the CD-yarns of the first group are at least partly visible from the paper-side and/or the machine-side of the fabric.

The fabric can be flat woven and can comprise a seam area for making the fabric endless, wherein the seam area preferably has seam loops formed by the MD-yarns for implementing a pintle joint. The pintle might be formed from a plurality of monofilament yarns or by a single monofilament yarn. If the fabric is flat woven, the MD-yarns correspond to the warp yarns and the CD-yarns correspond to the weft yarns during the manufacturing process in the weaving loom.

Finally, the invention also refers to a web-producing machine, such as a papermaker's machine for producing paper, tissue or board, comprising a previously described fabric, wherein the fabric is preferably applied in a dryer section of the web-producing machine.

In the following, the invention will be explained in more detail with reference to the attached figures wherein the figures are schematic drawing not true to scale.

DETAILED DESCRIPTION OF THE INVENTION

Figure 1:
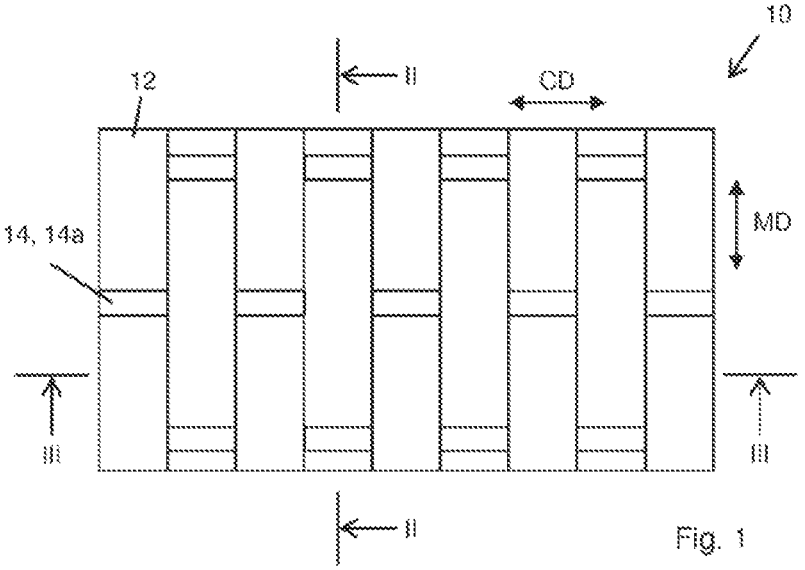
FIG. 1 shows a paper-side portion of an exemplary embodiment of the fabric according to the present invention.
Figure 4:
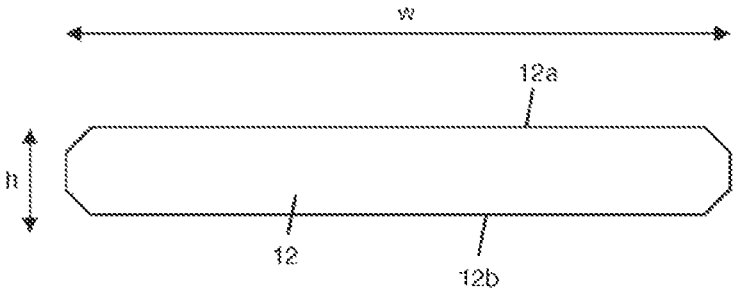
FIG. 4 shows an enlarged cross-sectional view of an MD-yarn of the fabric.

FIG. 1 shows a portion of a fabric 10 according to the present invention wherein the portion is seen from the paper-side of the fabric 10. However, since the fabric 10 has a substantially symmetrical weave pattern, FIG. 1 may equally refer to the machine-side thereof. The fabric preferably is a dryer fabric to be used as such in the dryer section of a machine for producing a fibrous web. The shown portion of the fabric 10 comprises nine MD-yarns 12 extending in machine direction MD of the fabric 10. All MD-yarns 12 have substantially the same cross-sectional shape that is shown in the enlarged view of FIG. 4, wherein in this exemplary embodiment the width-to-height ratio of the cross-sectional shape is about 11:1. For example the width w of the MD-yarn might be about 2.20 mm and the height h of the MD-yarn might be about only 0.20 mm. The cross-sectional shape of the MD-yarn 12 is octagonal, i.e. it is almost rectangular but with the edges cut off. The MD-yarn 12 has a substantially flat upper surface side 12*a* and a substantially flat lower surface side 12*b*, wherein the upper surface side 12*a* and the lower surface side 12*b* extend substantially parallel to each other. The MD-yarn 12 is a monofilament made from a polymeric material, such as PET, PPS, PCTA and/or POK, preferably by extrusion.

Figure 2:
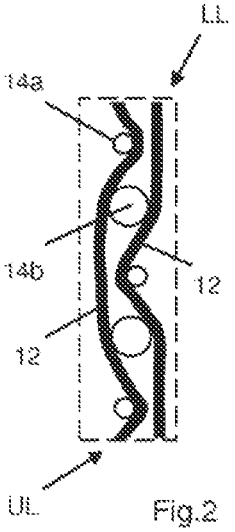
FIG. 2 shows a cross-sectional view of the fabric along line II-II in FIG. 1.
Figure 3:
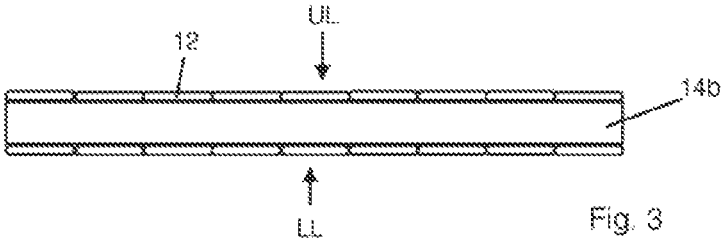
FIG. 3 shows a cross-sectional view of the fabric along line III-III in FIG. 1.

The MD-yarns 12 are interwoven with a plurality of CD-yarns 14. The CD-yarns 14 all have a substantially circular cross-section. However, the fabric 10 comprises at least two groups of CD-yarns 14 with differently dimensioned cross-sections. In FIG. 1 only three yarns of a first group of first CD-yarns 14*a* having a relatively small diameter are shown. In the view of FIG. 1 the weaving pattern of the MD-yarns 12 and the first CD-yarns 14*a* resembles a plain weave structure. As shown in FIGS. 2 and 3 the fabric 10 further comprises yarns of a second group of second CD-yarns 14*b* having a relatively large diameter. The second CD-yarns 14*b* are not visible from the paper-side of the fabric 10 (as shown in FIG. 1) nor from the machine-side. Instead, as best seen in FIG. 3, the second CD-yarns 14*b* extend straight in cross-machine direction CD of the fabric 10 between an upper layer UL of MD-yarns 12 and a lower layer LL of MD-yarns 12. The second CD-yarns 14*b* have no or hardly any crimp. The upper layer UL of MD-yarns 12 and the lower layer LL of MD-yarns do not intersect each other.

Figure 5:
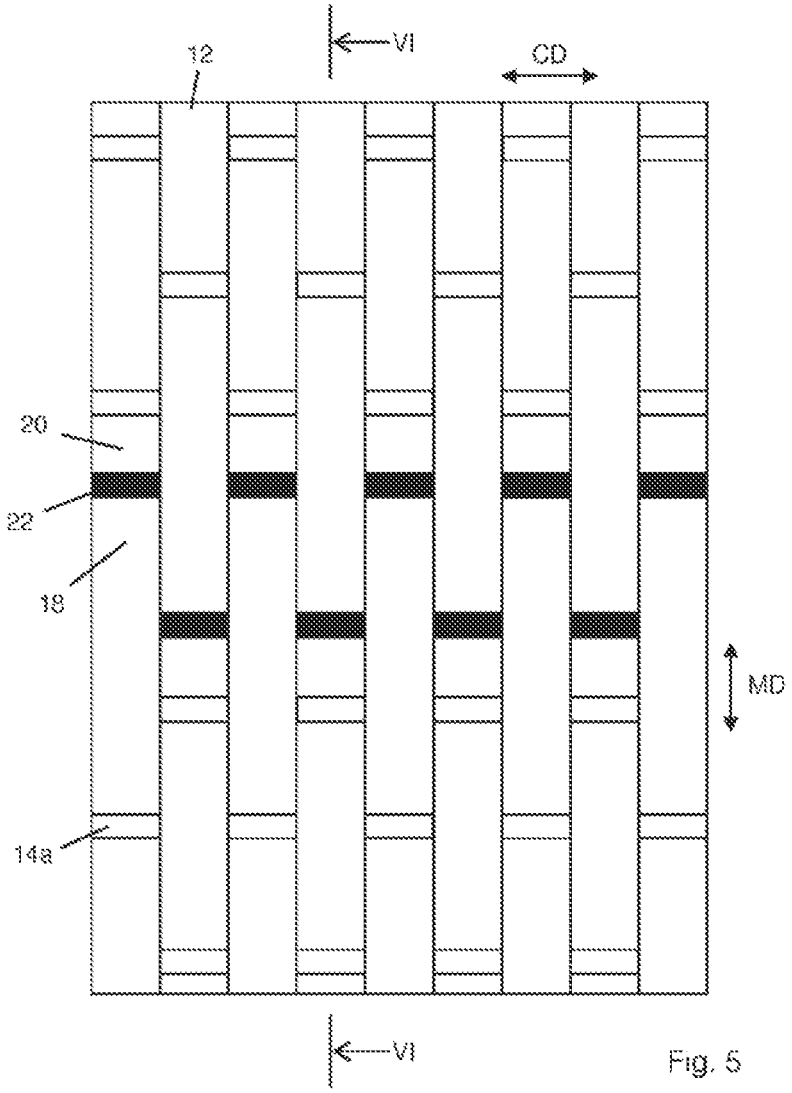
FIG. 5 shows a similar view on a paper-side portion of the fabric as FIG. 1 but comprising a seam area of that fabric.
Figure 6:
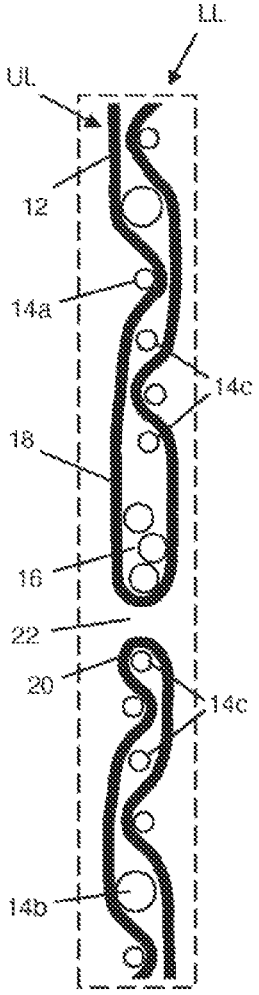
FIG. 6 shows a cross-sectional view of the fabric along line VI-VI in FIG. 5.

Finally, FIGS. 5 and 6 show a seam area of the fabric 10. Since the fabric 10 is flat woven, its longitudinal ends have to be joined together to make the fabric 10 endless. FIG. 5 shows a similar view on the paper-side of the fabric 10 as FIG. 1 and FIG. 6 shows a cross-sectional view along line VI-VI in FIG. 5. In the present exemplary embodiment the seam is implemented via a pintle 16. Here, the pintle 16 comprises three monofilament yarns extending in cross-machine direction CD of the fabric 10. The pintle 16 passes through a series of seam loops 18 formed by the MD-yarns 12. The MD-yarns 12 of the upper layer UL is woven back into the structure of the fabric 10, thus, integrally forming also the lower layer LL of the fabric 10 at least in the seam area. At each lateral end of the fabric 10 the MD-yarns 12 alternately form seaming loops 18 and binder loops 20. The seaming loops 18 of both longitudinal end of the fabric 10 are interdigitated in the web-producing machine to provide a closed channel for the pintle 16.

Between the seaming loop 18 of one longitudinal end of the fabric 10 and the opposite binder loop 20 of the other longitudinal end of the fabric 10 there may be provided a small gap 22, as indicated in FIG. 1 by a black rectangle.

Furthermore, in the seam area the fabric 10 may comprise third CD-yarns 14*c* for stabilizing the seam area. As shown in FIG. 6, four such third CD-yarns 14*c* are provided, two at each longitudinal end of the fabric 10. In the present exemplary embodiment the third CD-yarns 14*c* have a circular cross-section with substantially the same diameter as the circular cross-section of the first CD-yarns 14*a*. However, likewise the second CD-yarns 14*b*, the third CD-yarns 14*c* extend straight in cross-machine direction CD of the fabric 10 between the upper layer UL of MD-yarns 12 and the lower layer LL of MD-yarns 12. The first CD-yarns 14*a* and the third CD-yarns 14*c* may have for example a circular cross-section with a diameter of about 0.6 mm, whereas the second CD-yarns 14*b* may have for example a circular cross-section with a diameter of about 0.9 mm.

LIST OF REFERENCE SIGNS

10 fabric
12 MD-yarn
12*a* upper surface side
12*b* lower surface side
14 CD-yarn
14*a* first CD-yarn
14*b* second CD-yarn
14*c* third CD-yarn
16 pintle
18 seam loops
20 binder loops
22 gap
CD cross-machine direction
h height
LL lower layer
MD machine direction
UL upper layer
w width

The invention claimed is:

1. A fabric for a web-producing machine, the fabric being a double-layer fabric comprising:
a machine-side;
a paper-side; and
an upper layer and a lower layer forming the double-layer fabric;
MD-yarns having a non-circular cross-section, wherein said MD-yarns, which have the non-circular cross-section, include upper layer MD-yarns in said upper layer and lower layer MD-yarns in said lower layer, wherein a width-to-height aspect ratio of said MD-yarns is greater than 10:1; and
CD-yarns interwoven with said MD-yarns in a predetermined repeat pattern resulting in the fabric being a dryer fabric of a papermaker's machine for producing paper, tissue or board;
said upper layer MD-yarns interlacing with said CD-yarns; and
said lower layer MD-yarns interlacing with said CD-yarns;
wherein said upper layer MD-yarns do not intersect with said lower layer MD-yarns; and
wherein the fabric includes at least two groups of said CD-yarns with differently dimensioned cross-sections.

2. The fabric according to claim 1, wherein the width-to-height aspect ratio of said MD-yarns is not greater than 15:1.

3. The fabric according to claim 1, wherein a width of said MD-yarns is between 2.0 mm and 2.4 mm.

4. The fabric according to claim 1, wherein some of said CD yarns are disposed along their complete path between said upper layer MD-yarns and said lower layer MD-yarns, thus, not being visible from said paper-side and/or said machine-side of the fabric, whereas remaining said CD-yarns are at least partly visible from said paper-side and/or said machine-side of the fabric.

5. The fabric according to claim 1, wherein said MD-yarns and/or said CD-yarns are made of monofilaments.

6. The fabric according to claim 1, wherein said MD-yarns have a flattened shape with a flat upper surface side and a flat lower surface side, wherein said flat upper surface side and said flat lower surface side extend substantially parallel to each other.

7. The fabric according to claim 1, wherein said MD-yarns have an octagonal cross-section.

8. The fabric according to claim 1, wherein:
said CD-yarns have a circular cross-section; and
a diameter of said CD-yarns is not smaller than 0.5 mm and/or not larger than 1.0 mm.

9. The fabric according to claim 1, wherein the fabric contains at least a first group of said CD-yarns with a circular cross-section of a first diameter and a second group of said CD-yarns with a circular cross-section of a second diameter, the second diameter being greater than the first diameter, wherein a ratio of the second diameter to the first diameter is between 2:1 and 1:1.

10. The fabric according to claim 1, wherein the fabric is flat woven and contains a seam area for making the fabric endless, wherein said seam area has seam loops formed by said MD-yarns for implementing a pintle joint.

11. The fabric according to claim 1, wherein the width-to-height aspect ratio of said MD-yarns is at least 11:1.

12. The fabric according to claim 2, wherein the width-to-height aspect ratio of said MD-yarns is not greater than 12:1.

13. The fabric according to claim 3, wherein the width of said MD-yarns is 2.2 mm, and/or the height of said MD-yarns is 0.2 mm.

14. The fabric according to claim 5, wherein said monofilaments are selected from the group of a polymeric material, a PET, a PPS, a PCTA and a POK.

15. The fabric according to claim 9, wherein the ratio of the second diameter to the first diameter is 3:2.

16. The fabric according to claim 1, wherein a height of said MD-yarns is between 0.1 mm and 0.3 mm.

17. A web-producing machine, comprising:
a dryer section; and
a double layer fabric including:
a machine-side,
a paper-side, and
an upper layer and a lower layer forming the double-layer fabric,
MD-yarns having a non-circular cross-section, wherein said MD-yarns, which have the non-circular cross-section, include upper layer MD-yarns in said upper layer and lower layer MD-yarns in said lower layer, wherein a width-to-height aspect ratio of said MD-yarns is greater than 10:1, and
CD-yarns interwoven with said MD-yarns in a predetermined repeat pattern resulting in the fabric being a dryer fabric of a papermaker's machine for producing paper, tissue or board;
said upper layer MD-yarns interlacing with said CD-yarns, and
said lower layer MD-yarns interlacing with said CD-yarns,
wherein said upper layer MD-yarns do not intersect with said lower layer MD-yarns;
wherein the fabric includes at least two groups of said CD-yarns with differently dimensioned cross-sections; and
wherein the fabric is applied in said dryer section of the web-producing machine.

18. A fabric for a web-producing machine, the fabric comprising:
a machine-side;
a paper-side;
MD-yarns having a non-circular cross-section, wherein a width-to-height aspect ratio of said MD-yarns being greater than 10:1; and CD-yarns interwoven with said MD-yarns in a predetermined repeat pattern resulting in the fabric being a dryer fabric of a papermaker's machine for producing paper, tissue or board;

wherein the fabric contains at least two groups of said CD-yarns with differently dimensioned cross-sections;

wherein the fabric contains at least a first group of said CD-yarns with a circular cross-section of a first diameter and a second group of said CD-yarns with a circular cross-section of a second diameter, the second diameter being greater than the first diameter, wherein a ratio of the second diameter to the first diameter is between 2:1 and 1:1; and wherein said CD-yarns of said second group are not visible from said paper-side and/or said machine-side of the fabric, whereas said CD-yarns of said first group are at least partly visible from said paper-side and/or said machine-side of the fabric.

* * * * *